US006942218B2

(12) United States Patent
Davis et al.

(10) Patent No.: US 6,942,218 B2
(45) Date of Patent: Sep. 13, 2005

(54) DOMINO AND DICE GAME

(76) Inventors: Dalton W. Davis, P.O. Box 82, Streetman, TX (US) 75859; Dalton W. Davis, II, 1702 Limetree La., Duncanville, TX (US) 75137; Jarrod Davis, 1702 Limetree La., Duncanville, TX (US) 75137

( * ) Notice: Subject to any disclaimer, the term of this patent is extended or adjusted under 35 U.S.C. 154(b) by 0 days.

(21) Appl. No.: 10/455,335

(22) Filed: Jun. 6, 2003

(65) Prior Publication Data

US 2004/0245723 A1 Dec. 9, 2004

(51) Int. Cl.[7] ..... A63F 3/00; A63F 9/20

(52) U.S. Cl. ..... 273/268; 273/281; 273/287; 273/274; 273/293; D21/338

(58) Field of Search ..... 273/268, 281, 273/287, 274, 293, 145 R, 145 B, 146; D21/372, 338

(56) References Cited

U.S. PATENT DOCUMENTS 1,238,522 A * 8/1917 Kalista ..... 273/269
1,466,534 A * 8/1923 Kuen ..... 273/268
2,560,187 A 7/1951 Post
4,125,263 A 11/1978 Hamilton
4,359,227 A * 11/1982 Porciello ..... 273/268
4,410,182 A * 10/1983 Francis ..... 273/268
4,421,315 A * 12/1983 Cutler ..... 273/268
4,443,012 A 4/1984 Makovic et al.
D323,859 S * 2/1992 Russell ..... D21/372

OTHER PUBLICATIONS

"Shut The Box", Games Of The World, Holt, Rinehardt and Winston, New York, pp. 143–144, 1975.*

* cited by examiner

*Primary Examiner*—Benjamin Layno
(74) *Attorney, Agent, or Firm*—Richard C. Litman

(57) ABSTRACT

The domino and dice game includes a series of dominos having counts thereon which correspond to the possible counts generated by a pair of conventional cubical dice. The dominos are initially positioned face up, and the dice are tossed. Dominos having counts corresponding to the resulting count on the dice, are turned face down. Play continues by a single player until no more domino moves are possible, whereupon play transfers to the next player. Score is according to the number of dots displayed upon the remaining face up dominos after a turn is completed, with low score winning the round after all players have played. The present game also includes a playing box, with the box having at least one row of dominos pivotally secured thereacross and a dice tossing area. The playing box may include additional domino rows for doubles and blank dominos, if desired.

18 Claims, 4 Drawing Sheets

DOMINO AND DICE GAME

BACKGROUND OF THE INVENTION

1. Field of the Invention

The present invention relates generally to wagering games and games of chance, and more particularly to a game involving the use of both dominos and dice. The present game is played using a specialized apparatus which includes a series of dominos pivotally affixed thereto. Dice are tossed in one area of the game apparatus, with the resulting numbers being used to control movement of the dominos. Scoring is according to the spots remaining exposed on the dominos when no further moves can be made, in accordance with the rules of play.

2. Description of the Related Art

Various games of chance involving the use of dice have been known since the earliest of times. The most common form of dice is the conventional cubical configuration, with each of the dice having markings indicating the numbers one through six on their six respective sides. Such dice are used in the present game. Perhaps the most widely known game involving cubical dice is the gambling game of craps, in which wagers are placed upon the likelihood of a player rolling or failing to roll a given number.

Another relatively ancient gaming apparatus is the domino. As with dice, various forms are known, but by far the most widely used type of domino comprises a set of relatively thin rectangular tiles, each tile having a blank surface on one side and a numbered surface on the opposite side. The numbered surface is divided into two square areas, with each having a series of markings representing numbers from zero (or no marking) through six. Certain tiles of such a domino set are used in the present game. The most widely played game using such a domino set involves placement of the dominos sequentially on a playing surface, with players attempting to match the number pattern of one of the played dominos with a domino from their own randomly selected set.

The development of playing cards also led to the development of various gambling and other games involving such playing cards. Eventually, a few games were developed using both playing cards and dice in a single game, and/or using specially configured cards having markings resembling those on the faces of a set of dice. The present inventors are aware of a few such games, as described in the specific discussion of the related art below. However, the present inventors are not aware of any games which have been developed which utilize a combination of dice and dominos in their play, nor of any such dice and domino game which utilizes a specially configured playing apparatus with a series of captured dominos thereon which are manipulated in accordance with numbers generated by the tossing of a pair of dice.

Accordingly, the domino and dice game developed by the present inventors is played with a specially configured playing apparatus or box containing one or more rows of dominos pivotally mounted thereon. The apparatus includes an area for tossing a pair of dice, as well. The present game is played by tossing the dice and turning down any domino or dominos having numbers which equal the numbers tossed on the dice. The total combination may be used, or dominos matching the specific numbers of the dice may be required. The pivotally mounted dominos which match the number(s) rolled with the dice are turned face down. A player's turn continues until it is not possible to match the number(s) of a roll of the dice with the remaining face up dominos, whereupon the dots showing on the remaining face up dominos are counted to determine the score and play passes to the next player. The object is to gain the lowest score, i.e., turn over as many dominos as possible. Wagers may be placed upon the outcome, in accordance with conventional wagering used in the game of craps.

A discussion of the related art of which the present inventors are aware, and its differences and distinctions from the present invention, is provided below.

U.S. Pat. No. 2,560,187 issued on Jul. 10, 1951 to Durrel E. Post, titled "Combination Card And Dice Game," describes a relatively simple game using a specially configured deck of cards, with the cards comprising several suits each having markings for the numbers one through seven thereon. Post also uses specially configured dice which correspond to the suits of his cards. The game is played by turning the cards face down, either as a single suit or a mix of the suits. The top card is turned face up and the dice are tossed, with the object being to match the number (and suit, if appropriate) of the face up card with the toss of the dice. A successful match allows the card to be retired, and the next card is turned face up. The game may be played as a solitaire game, or as a competitive game with two or more participants taking turns. Post does not disclose the use of dominos in his game, nor any provision for manipulating combinations of two or more cards from one toss of the dice, as may be done with two or more dominos in the present game. Moreover, Post does not provide any apparatus for holding or containing his cards or dice, as is provided in the present game.

U.S. Pat. No. 4,125,263 issued on Nov. 14, 1978 to Joe W. Hamilton, titled "Domino Game," describes a game using two sets of dominos with twenty-eight dominos in each set. The sets are conventional, with the exception of markings indicating their additive or subtractive nature in play. The Hamilton game is played similarly to conventional domino play, but scoring may be accomplished by adding or subtracting dots of a domino at the end of a row, according to the additive or subtractive nature of the specific domino played. Hamilton does not disclose the use of dice to determine the manipulation of any of the dominos, nor does he provide a box or structure with dominos of varying denominations secured thereto, as is done with the present domino and dice game invention.

Finally, U.S. Pat. No. 4,443,012 issued on Apr. 17, 1984 to Edward M. Makovic et al., titled "Combination Card And Dice Game," describes a game which requires a specialized deck of cards for play. Makovic et al. provide a total of sixty cards in six suits, with each suit having cards numbered from two to twelve, less the number seven. Each player receives a predetermined number of cards, with players taking turns tossing a pair of dice. Cards are discarded or turned down whenever a match is made between the number rolled with the dice, and one of the cards in that player's hand. The present game does not require a specialized deck of cards, but rather provides a much more elegant means of matching a series of numbers which may be generated using a pair of dice, by using a series of dominos having similar numbers on their faces. The present game differs considerably from the Makovic et al. game, in that (1) the present game also provides a specific apparatus which permanently captures the dominos thereon, and allows their manipulation during play; (2) the present game may make use of all of the numbers from two through twelve, which may be generated using a pair of dice; (3) the present game may also provide for side bets to be placed upon the outcome of each toss of the dice, and/or corresponding manipulation of the dominos of the game; and (4) the present game may also utilize dominos having double numbers or blank areas on their faces, whereas Makovic et al. does not provide any cards having such features. Other distinctions are noted as well, such as the playing box provided for the present game, etc.

None of the above inventions and patents, taken either singly or in combination, is seen to describe the instant invention as claimed. Thus a domino and dice game solving the aforementioned problems is desired.

SUMMARY OF THE INVENTION

The domino and dice game of the present invention utilizes a pair of dice to govern the turnover of a series of dominos. The dominos used in the present game are pivotally mounted in a playing box, and are initially turned face up with their dot faces exposed. The dominos are turned face down when matches are made. Scoring is accomplished according to the dots displayed on the remaining upturned dominos whenever a dice toss does not provide any further matches with the remaining upturned dominos. The dots are counted and play advances to the next player, with the low score winning the round after all players have played.

The playing box includes at least one row of eleven dominos having pip counts from two to twelve, corresponding to the possible numbers which may be generated by a pair of conventional cubical dice. A second row may be provided for double dominos, in which both halves of the face contain an identical count. In addition, a third row may be provided for blank dominos, allowing further combinations to be matched to the number generated by the dice toss. A wagering board may also be provided, with side bets placed upon the outcome of each dice toss and/or domino match, generally in accordance with the wagering rules used in craps.

Accordingly, it is a principal object of the invention to provide a combination domino and dice game in which a series of dominos having numbers corresponding to the possible numbers generated by a single toss of a pair of cubical dice are overturned in accordance with the numbers produced by the dice toss.

It is another object of the invention to provide a domino and dice game including a playing box, with the playing box having the domino series pivotally secured therein so they may be selectively overturned according to a toss of the dice.

It is a further object of the invention to provide a playing box for a domino and dice game which includes a dice tossing area, and optionally includes second and third rows of dominos having double and blank dominos, respectively, therein.

Still another object of the invention is to provide a combination domino and dice game which includes a wagering board, whereby wagers may be placed upon the outcome of dice tosses and/or domino turnovers, generally according to the rules of craps.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of a wagering game combining both dominos and dice in a single game. A game apparatus includes a box having a series of dominos pivotally affixed thereto, and a playing surface for tossing a pair of conventional cubical dice. The object of the game is to turn over any dominos which match a number rolled with the dice, until no further matches can be made. Scoring is according to the exposed dots on the remaining face up dominos. Wagers may be placed upon the outcome of the dice tosses and resulting domino turnovers.

Figure 1:
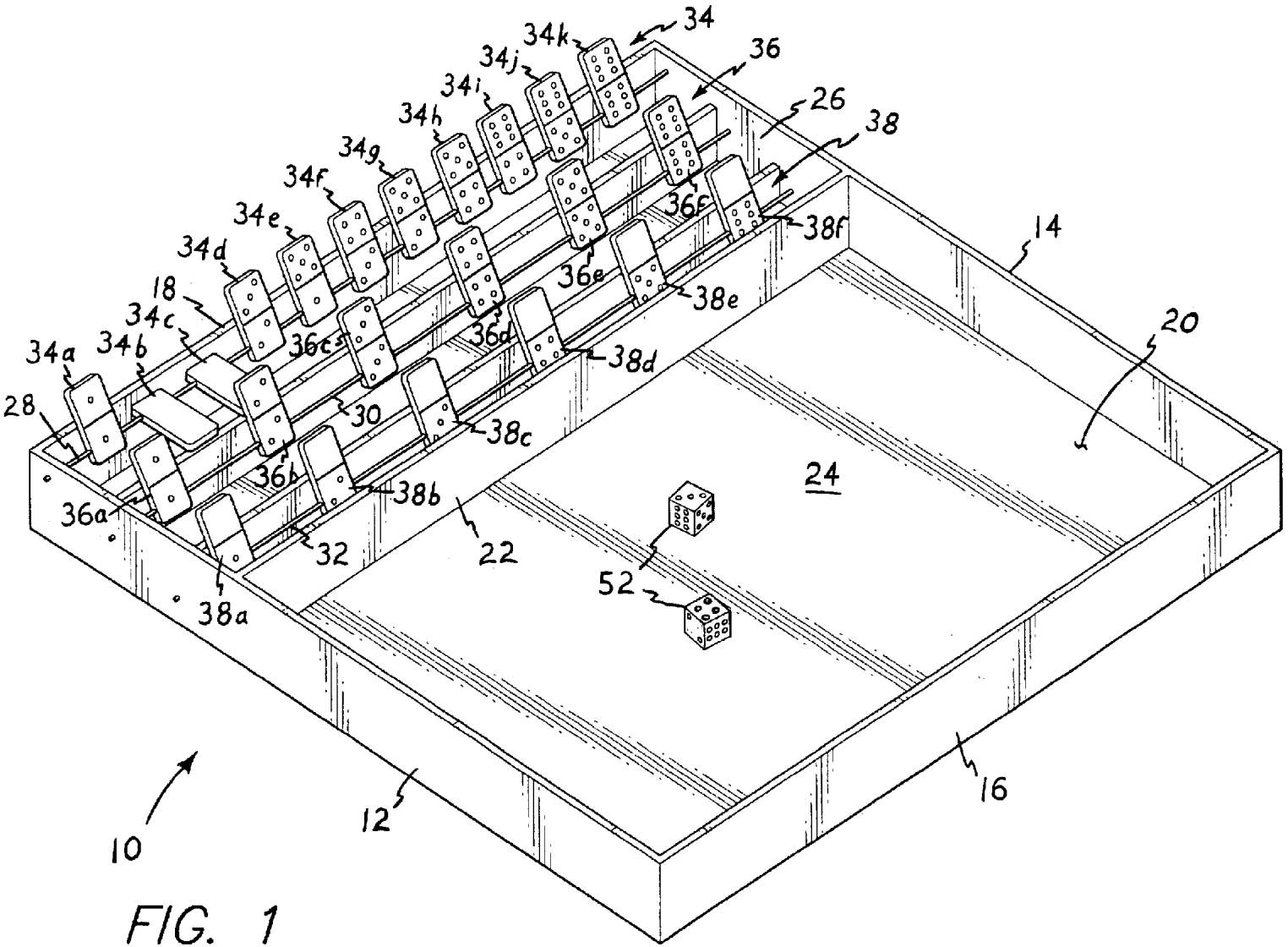
FIG. 1 is a perspective view of the playing box for the domino and dice game of the present invention, showing a series of rows of dominos attached thereto and a dice tossing area.
Figure 2:
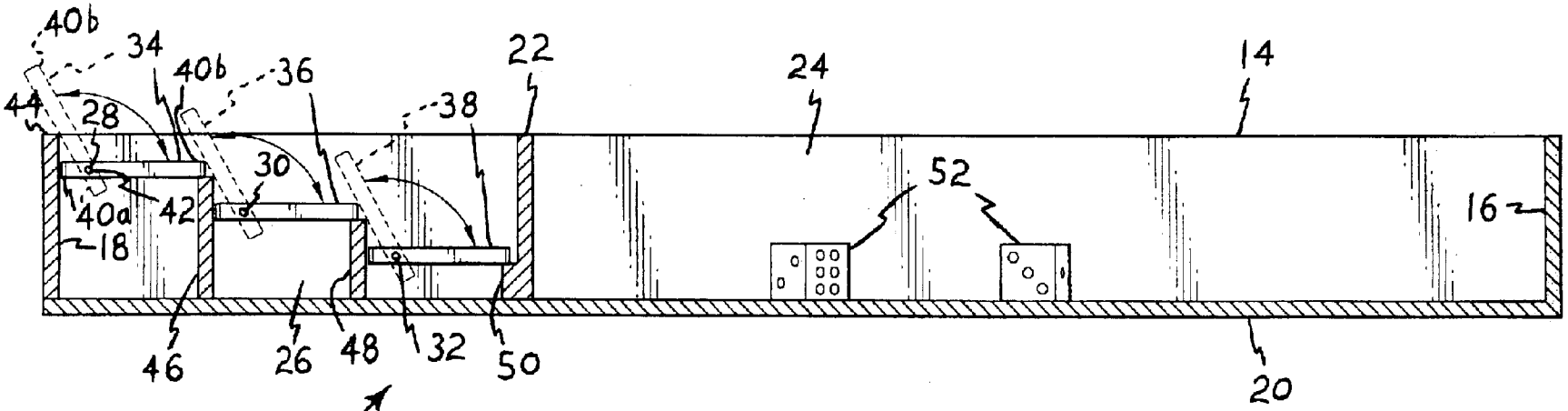
FIG. 2 is a side elevation view in section of the playing box of FIG. 1, showing further details thereof and the operation of the pivotally attached dominos.

FIGS. 1 and 2 of the drawings respectively provide a perspective view and a side elevation view in section of the playing apparatus of the present domino and dice game invention. The playing box 10 includes opposite first and second lateral walls 12 and 14 and opposite front and rear walls 16 and 18, which define the periphery of the playing box 10. A floor 20 extends between the lower edges of the walls 12 through 18, to close the bottom of the box 10. The upper portion of the box 10 remains open for access to the internal volume of the box 10. An intermediate wall 22 extends across the width of the box 10, between the two lateral walls 12 and 14. The intermediate wall 22 divides the interior of the box 10 into a dice tossing area 24 between the intermediate wall 22 and the front wall 16, and a domino area 26 between the intermediate wall 22 and the rear wall 18.

The playing box 10 of FIGS. 1 and 2 includes first, second, and third laterally disposed domino pivot rods, respectively 28, 30, and 32, extending between the two lateral walls 12 and 14 and across the domino area 26. Each of these domino pivots 28 through 32 includes a series of dominos independently pivotally secured thereon, for use in the play of the present game. However, it should be noted that while three such pivot rods 28 through 32 and their associated dominos are illustrated in FIGS. 1 and 2, the present game may be played, and the playing box provided, using only a single row of dominos, if so desired. Alternatively, the second row may be added for doubles play, if so desired, with the third row providing further alternative play.

The first domino row 34 includes a series of eleven dominos thereon, respectively dominos 34*a* through 34*k* from lowest to highest numerical value or count. These dominos 34*a* through 34*k* correspond to the totals of all of the additive numbers attainable using a pair of conventional, cubical dice with their faces each representing the numbers one through six, i.e., the numbers two through twelve inclusive. The second domino row 36 is provided between the first row 34 and the intermediate wall 22, which includes all of the doubles dominos 36*a* through 36*f*, respectively having representations of the numbers one through six disposed symmetrically upon each portion of their numbered faces. Finally, the optional third domino row 38 may be placed between the second row 36 and the intermediate wall 22 to include a series of six dominos 38*a* through 38*f*, respectively having representations of the numbers one through six on one portion of their faces and a blank area on the opposite portion.

FIG. 2 illustrates details of the pivoting domino rows 34 through 38. Each domino includes a first end 40*a* and an opposite second end 40*b*, as indicated for the first row dominos 34 in FIG. 2. A pivot pin passage 42 extends laterally through each domino, with the passage 42 being positioned closer to the first end 40*a* than to the second end 40*b* of the dominos. This results in an over center action for the freely pivoting dominos, with the dominos tending to either pivot rearwardly with their numbered faces disposed upwardly and forwardly, as shown in the broken line positions in FIG. 2, or with their numbered faces facing downwardly and concealed, as shown in solid lines in FIG. 2.

Pivotal movement of the dominos is limited by a backstop member and a forward limiting member. In the playing box 10 of FIGS. 1 and 2, the first domino row pivot rod or pin 28 is positioned slightly forwardly and below the upper edge 44 of the rear wall 18. Thus, a domino of the first domino row 34 is limited in its rearward motion by the upper edge 44 of the rear wall 18, which serves as a backstop for each of the dominos of the first domino row 34.

In a similar manner, a second row backstop member 46 may be installed between the first domino pivot rod 28 and the optional second row domino pivot rod 30 and serves the same function of limiting rearward motion of the second row of dominos 36, as shown by the broken line position of those dominos 36 in FIG. 2. The upper edge of this second row backstop member 46 also serves to limit the forward motion of the dominos of the first domino row 34, as the second ends 40*b* of those dominos in their forwardmost positions come to rest upon the upper edge of the second row backstop member 46.

Where a third domino row 38 is provided, a third row backstop member 48 may be installed between the second and third row domino pivot rods 30 and 32 and serves the same function of limiting rearward motion of the third row of dominos 38, as shown by the broken line position of those dominos 38 in FIG. 2. The upper edge of this third row backstop member 48 also serves to limit the forward motion of the dominos of the second domino row 36, in a manner similar to that described further above for limiting the forward motion of the dominos of the first row 34.

The lateral intermediate wall 22 is positioned immediately forwardly of the third domino row 38. However, each of the domino rows 34 through 38 is positioned slightly lower than the next row immediately rearward, as determined by the positions of the pivot pins 28 through 32. This facilitates viewing the faces of the dominos in each row when all dominos are upturned, as one may readily view the dominos of a rearward row over the dominos of the immediately preceding row, from the front of the playing box 10. This results in the second ends of the dominos of the dominos of the third domino row 38 being somewhat below the upper edge of the intermediate wall 22, when the third row dominos 38 are pivoted forwardly. Accordingly, a forward stop or step 50 may be provided on the back of the intermediate wall 22, to limit the forward pivoting movement of the third row dominos 38 to a generally horizontal position, as shown in solid lines in FIG. 2.

In the event that only a single domino row is provided in the playing box, the intermediate wall 22 is positioned immediately forwardly of the second ends 40*b* of the first row dominos 34 in their forwardly and downwardly facing positions. A forward stop having a height similar to that of the second row backstop 46 may be applied to the back of the intermediate wall 22 to serve as a forward limit for the motion of the first row dominos 34, where only a single row is provided. This may be envisioned by eliminating the second and third row dominos 36 and 38 and third row backstop 48, and moving the intermediate wall 22 from the position shown in FIG. 2 to a position adjacent the forward side or surface of the second row backstop 46.

The present combination domino and dice game may be played as a wagering or gambling game, with players placing wagers on the outcome of each round of play as to the scores achieved in tossing the dice to allow the turnover of the dominos in accordance with the rules explained in detail further below. However, additional wagers may be placed upon various aspects of the play of the present game, if so desired. As the present game uses a pair of conventional cubical dice, e.g. the dice 52 illustrated in FIGS. 1 and 2, wagers may be placed which are comparable to those known in various dice games, e.g., craps, etc. However, rather than betting upon the outcome of a toss of the dice, the present game may provide for wagers upon the turnover of the various dominos of the playing box 10.

Figure 3:
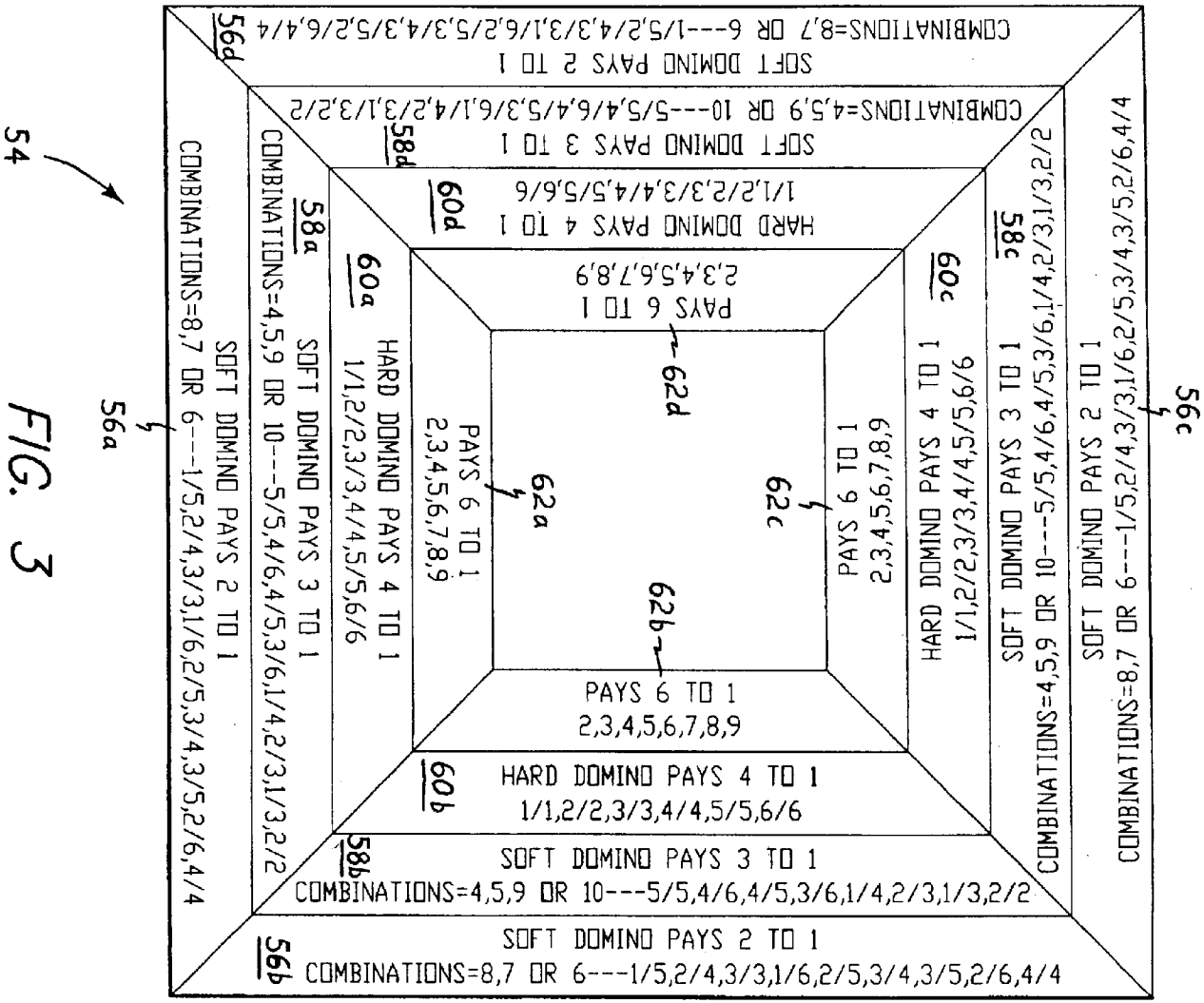
FIG. 3 is a top plan view of the wagering board or surface which may be used with the present game, for wagering on the outcome of the dice tosses and/or domino turnovers.

Accordingly, FIG. 3 illustrates a wagering surface 52 which may be used with the present game. The wagering surface 54 includes four identical sides or areas, and is thus configured for four players. It will be seen that additional players may be accommodated by changing the configuration of the surface 54, e.g. a hexagonal layout for six players, octagonal for eight, etc. A series of wagering areas are provided in each of the separate player areas, with these wagering areas briefly describing or indicating the nature of the wager placed thereon. The first or outermost of these wagering areas, i.e. areas 56*a* through 56*d* around the table or surface 54, provide for a series of "soft domino" wagers, analogous to "soft numbers" in craps, i.e., not limited to specific combinations. These wagers provide payouts for any combination totaling eight, seven, or six.

Thus, a player (or person wagering on the play) who tosses a total count of seven with the two dice 52, with the individual dice respectively having a four count and a three count, as shown in FIG. 1, may turn over the two dominos 34*b* and 34*c* respectively having a total dot count of three and four. If a wager was placed upon the first wagering area 56*a* (or 56*b* through 56*d*) and the player tossed a dice total equaling six, seven, or eight, and was able to turn over dominos having corresponding counts, then the person placing the wager would win his or her bet. The odds listed may be adjusted as desired.

The next wagering areas 58*a* through 58*d*, respectively inboard of the outermost areas 56*a* through 56*d*, provide for wagers on domino turnovers of combinations totaling four, five, nine, or ten. As in the case of the wagers in the first wagering areas 56*a* through 56*d*, the wagers in the second areas 58*a* through 58*d* are for "soft" combinations, i.e., having no requirement for any specific numbers so long as the total equals one of the numbers shown in the wagering area. Again, while wagers and payouts could be provided on the outcome of the dice tosses, the present game requires the dominos of the playing board 10 to be turned over in accordance with the outcome of one or more dice tosses. Accordingly, it is preferred that the wagers be placed, and any payouts provided, according to the turnover of the dominos in accordance with the tossing of the dice, rather than being based solely upon the numbers generated by the dice. It will be seen that this will affect the odds to some extent, depending on which dominos remain to be turned over during play.

The next wagering fields or areas 60*a* through 60*d* of the wagering surface 54 describe wagers and payout odds for "hard" domino numbers, i.e., those "double" dominos of the second row 36 having matching or equal numbers on each end thereof. If a player tosses a double number with the dice 52, e.g. double fours, he or she may then turn over the domino 36*d* having a four on each end portion thereof. A wager placed upon one of the "hard domino" wagering areas 60*a* through 60*d* of the board 54, would result in a payout for such a winning wager. Again, the odds shown on the surface or table 54 may be adjusted as desired, with the odds of 4:1 shown being exemplary for casino play where a payout is provided for any non-specific double number combination.

Finally, the innermost wagering areas 62*a* through 62*d* provide for wagers on other domino turnover outcomes comprising the specific numbers shown. The odds here may be somewhat higher than those provided for more general number combinations of other wagering areas of the wagering board or surface 54, as the innermost wagering areas 62*a* through 62*d* may require that the wager be placed upon one of the specific numbers of that area, with payout only occurring when that specific number is "hit" and the corresponding domino(s) turned over. As in the cases of the other wagering areas of the table or surface 54, the odds may be adjusted as desired, depending upon the specific dominos used in the game, casino and/or other regulating body rules and regulations, etc.

Figure 4:
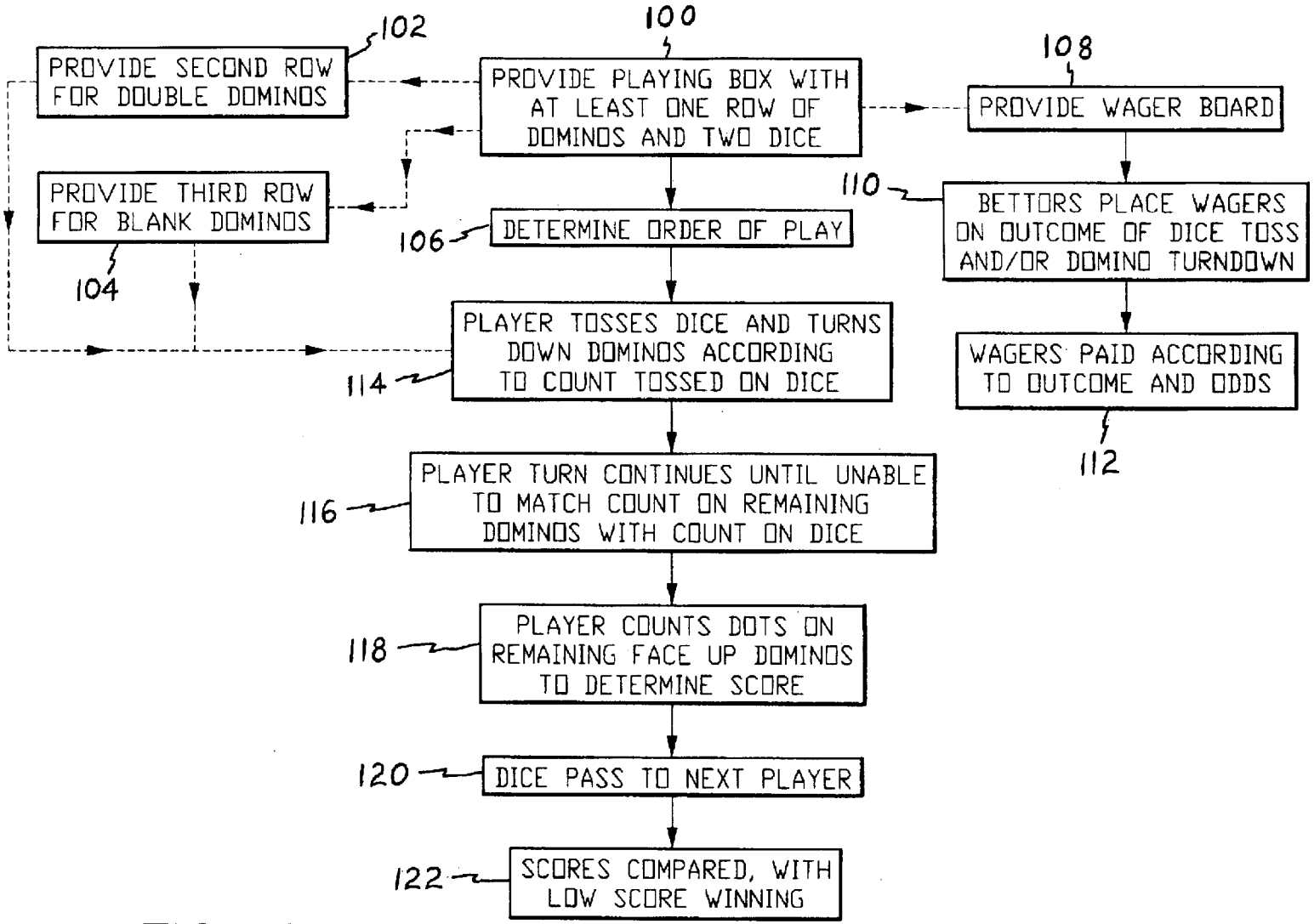
FIG. 4 is a flow chart showing the basic steps in the method of play of the present domino and dice game.

FIG. 4 of the drawings provides a flow chart or diagram generally describing the basic steps in the method of play of the present combination domino and dice game. Initially, a playing box having at least one row of dominos pivotally secured therein, and a pair of dice, is provided, generally in accordance with the playing box 10 structure illustrated in FIGS. 1 and 2 and described in detail further above. Where play using doubles dominos and blank portion dominos is desired, corresponding second and third domino rows may be added optionally, as shown in the box 10 of FIGS. 1 and 2. These steps of providing a single row, two row, or three row playing box are indicated respectively as the first step 100 and optional steps 102 and 104 of the flow chart of FIG. 4. The playing box 10 is readied for play by inverting and tilting the box to allow all of the dominos pivotally secured therein, to pivot to their upward and rearward positions with their numbered faces visible from the front of the box. The box 10 is then turned upright and placed upon a generally level surface for play.

Next, the order of play is determined, as indicated by the fourth step 106 of FIG. 4. The present game is well suited for solitaire play, if so desired. However, where multiple players are playing, the order of play must be determined. This may be accomplished by having each player toss the dice 52, or a single die, in the dice tossing area 24 of the playing box 10 and comparing the numbers tossed. The order of play may be from low to high, or from high to low, numbers tossed using the die or dice 52. Other selection methods may be used as desired.

If wagers are to be placed upon the outcome of the dice tosses and corresponding turnover of dominos on the playing box, then a wagering board or surface 54, as shown in FIG. 3, is preferably provided, generally in accordance with the optional fifth step 108 of the FIG. 4 chart. Players or others may place their wagers in accordance with the wagering outlines described on the wagering surface 54, wagering on the outcome of various dice tosses and/or corresponding domino turnovers, generally as indicated by the optional sixth step 110 of FIG. 4. Payouts are provided in accordance with the outcome of the play, the amount wagered, and the odds for the specific wager, generally in accordance with the optional seventh step 112 of FIG. 4.

Actual play is initiated when the first player (or sole player, for solitaire play) tosses the two dice 52, and uses the resulting number to turn over one or more of the dominos pivotally secured across the domino area 26 of the playing box 10, generally as indicated by the eighth step 114 of FIG. 4. A pair of conventional cubical dice will always generate a number from two to twelve, inclusive. Accordingly, a series of eleven dominos 34*a* to 34*k* having numbers from two to twelve, inclusive, are provided along the first domino row 34 of the playing box 10. In the example illustrated in FIG. 1 of the drawings, the player has rolled a four and a three using the two dice 52, and has turned over the corresponding dominos 34*b* and 34*c*, respectively having counts of three and four, to their face down positions. Play continues in this manner until the player has no further matches between the dice and the remaining face up dominos.

The optional second and third domino rows 36 and 38 provide for further options in the play of the present game. The provision of a second row 36 containing a series of six dominos 36*a* through 36*f* having symmetrically disposed pairs of numbers ranging from one through six, allows a player rolling doubles with the dice 52 (i.e., identical counts on both of the dice) to turn over a doubles domino corresponding to the doubles count attained with the dice 52. For example, if a player were to toss double fours with the dice 52, the player would turn over the double four domino 36d of the second domino row 36. Optionally, the player may turn over dominos in the first domino row 34 to match the eight count achieved in the above example, if so desired. However, as there are several dice pair combinations which total eight, but only one of which is doubles, the astute player would turn over the single domino 36*d* having double four counts thereon, for a total of eight, when rolling double fours with the dice 52. This would leave the option open for turning over other combinations of first row dominos, e.g. the two count and six count dominos 34*a* and 34*e* (the five and one counts of the domino 34*e* equaling six), in the event that a non-double eight count were to be rolled in the future.

Another option of the present domino and dice game is the provision of a third domino row 38 across the box 10, as shown in FIG. 1. This row may include six dominos 38*a* through 38*f*, respectively having representations of the numbers one through six on one half of their number faces, and a blank area on the opposite half. These "blank" dominos 38*a* through 38*f* provide additional versatility in the play of the present game. For example, if a player were to toss a total of nine using the two dice 52, and only the first row dominos 34*a* (having a total count of two) and 34*d* (having a total count of five) remained upright, with all other dominos of the first row having been matched and turned over, the player could use the blank domino 38*b* (having a count of two on its numbered or dotted face half) to add to the two dominos 34*a* and 34*d* of the first row, to make the appropriate total. It is not required that play utilize such a row of blank dominos, but the present game allows for this option when third row of blank dominos 38 is provided in the playing box 10.

The game continues as described above, with the same player continuing to toss the dice until no further numerical matches can be made with any of the exposed numerical faces of any of the dominos in play, in accordance with the ninth step 116 of FIG. 4. At this point, the player counts the dots displayed on the remaining upwardly facing dominos to determine his or her score, as indicated by the tenth step 118 of FIG. 4. The dice 52 are then passed to the next player, who turns all of the dominos to face upwardly and forwardly so their numbered faces are visible to the player(s), and play continues with the second player, generally as described above for the first player and as indicated by the eleventh step 120 of FIG. 4. Once all players have taken their turns, their scores are compared, with the lowest score winning the game, generally as indicated by the twelfth and final step 122 of the flow chart of FIG. 4. Playoff rounds may be played in the event of a tie.

In conclusion, the present combination domino and dice game invention provides a most interesting and enjoyable leisure time game or activity, combining game devices and aspects which were never before used in combination. The versatility of the present game provides wide appeal, with the nature of the game allowing for solitary play as well as group play. The use of dice with the present game provides for optional side bets to be placed upon the outcome of the tossing of the dice, or more precisely, upon the turnover of dominos on the playing board as a result of the dice tosses. Accordingly, the present game may be used as a leisure time game among friends or acquaintances, a party game, or more formally, as a casino game with wagering upon each individual dice toss and domino turnover, as well as upon the outcome of each game.

It is to be understood that the present invention is not limited to the embodiments described above, but encompasses any and all embodiments within the scope of the following claims.

We claim:

1. A domino and dice game apparatus, comprising:

a playing box having:

opposed first and second lateral walls and opposed front and rear walls, defining a periphery for said playing box; and a floor extending between said first and second lateral walls and said front and rear walls of said playing box;

an intermediate wall extending between said lateral walls of said playing box, the intermediate wall defining:

a dice tossing area disposed between said intermediate wall and said front wall of said playing box; and a domino area disposed between said intermediate wall and said rear wall of said playing box;

a first laterally disposed domino pivot extending across said domino area and between said lateral walls of said playing box;

a plurality of dominos disposed along first laterally disposed domino pivot, with each of said dominos being independently pivoted along said first laterally disposed domino pivot;

a second laterally disposed domino pivot extending across said domino area and between said lateral walls, between said first laterally disposed domino pivot and said intermediate wall of said playing box;

a plurality of dominos disposed along said second laterally disposed domino pivot, with each of said dominos of said second laterally disposed domino pivot being independently pivoted along said second domino pivot;

said plurality of dominos of said second domino pivot comprises six doubles dominos having double counts totaling from two to twelve, inclusive; and a pair of cubical dice.

2. The domino and dice game apparatus according to claim 1, wherein said plurality of dominos comprises eleven dominos having respective counts from two to twelve, inclusive.

3. The domino and dice game apparatus according to claim 1, wherein:

each of said dominos further includes a first end and a second end opposite said first end;

each of said dominos further includes a laterally disposed pivot passage formed therethrough, with each said pivot passage being positioned closer to said first end than to said second end of each of said dominos; and said rear wall of said playing box forms a backstop for said dominos, limiting rearward rotation thereof.

4. The domino and dice game apparatus according to claim 1, further including a second row backstop disposed between said first laterally disposed domino pivot and said second domino laterally disposed pivot of said playing box, limiting rearward rotation of said dominos of said second domino pivot and limiting forward rotation of said dominos of said first domino pivot.

5. The domino and dice game apparatus according to claim 1, further including:

a third laterally disposed domino pivot extending across said domino area and between said lateral walls, between said second domino pivot and said intermediate wall of said playing box;

a plurality of dominos disposed along said third domino pivot, with each of said dominos of said third domino pivot being independently pivoted along said third domino pivot; and said plurality of dominos of said third domino pivot comprises six blank dominos having blank portions and count portions totaling from one to six, inclusive.

6. The domino and dice game apparatus according to claim 5, further including a third row backstop disposed between said second domino pivot and said third domino pivot of said playing box, limiting rearward rotation of said dominos of said third domino pivot and limiting forward rotation of said dominos of said second domino pivot.

7. The domino and dice game apparatus according to claim 1, further including:

a wagering surface;

a plurality of identical wagering areas disposed upon said wagering surface; and a plurality of domino numerical combinations and payout odds disposed upon each of said wagering areas.

8. A method of playing a domino and dice game using the apparatus of claim 1, comprising the steps of:

(a) pivoting all of the dominos to an upwardly facing position, with the counts being visible;

(b) tossing the dice, and determining a numerical count between two and twelve inclusive according to the dice;

(c) turning dominos face down which have counts matching the numerical count of the dice toss;

(d) continuing in accordance with steps (b) and (c) until none of the remaining upwardly facing dominos match the count resulting from a dice toss;

(e) counting the total number of counts visible on the remaining upwardly facing dominos, thereby determining a score; and (f) providing a plurality of domino numerical combinations and payout odds.

9. A method of playing a domino and dice game, comprising the steps of:

(a) providing a playing box having opposed first and second lateral walls and opposed front and rear walls defining a periphery, a floor extending between the first and second lateral walls and the front and rear walls, and an intermediate wall extending between the lateral walls of the playing box;

(b) defining a dice tossing area disposed between the intermediate wall and the front wall of the playing box;

(c) defining a domino area disposed between the intermediate wall and the rear wall of the playing box;

(d) installing at least a first laterally disposed domino pivot extending across the domino area and between the lateral walls of the playing box;

(e) pivotally installing a plurality of dominos along the first laterally disposed domino pivot, with each of the dominos having a series of counts thereon and being independently pivoted along the first laterally disposed domino pivot;

(f) pivoting all of the dominos to an upwardly facing position, with the counts being visible;

(g) installing a second laterally disposed domino pivot extending across the domino area and between the lateral walls of the playing box:

(h) pivotally installing six doubles dominos along the second laterally disposed domino pivot, with the doubles dominos having double counts totaling from two to twelve, inclusive, and being independently pivoted alone the second laterally disposed domino pivot;

(i) providing a pair of cubical dice;

(j) tossing the dice, and determining a numerical count between two and twelve inclusive according to the dice;

(k) turning dominos face down which have counts matching the numerical count of the dice toss;

(l) continuing in accordance with steps (j) and (k) until none of the remaining upwardly facing dominos match the count resulting from a dice toss; and (m) counting the total number of counts visible on the remaining upwardly facing dominos, to determine a score.

10. The method of playing a domino and dice game according to the method of claim 9, further including the steps of:

(a) selecting a plurality of players;

(b) determining an order of play comprising a first player and at least one subsequent player;

(c) tossing the dice by the first player until none of the remaining upwardly facing dominos match the count resulting from a dice toss;

(d) counting the total number of counts visible on the remaining upwardly facing dominos, to determine a first player score;

(e) passing the dice to the at least one subsequent player;

(t) proceeding in accordance with steps (c) and (d) above for the at least one subsequent player; and (g) determining a winning player by comparing the scores of the first player and at least one subsequent player.

11. The method of playing a domino and dice game according to the method of claim 9, wherein the step of installing the plurality of dominos along the domino pivot comprises selecting and installing eleven dominos having respective counts from two to twelve, inclusive.

12. The method of playing a domino and dice game according to the method of claim 9, further including the steps of:

(a) defining a first end and a second end for each domino;

(b) forming a lateral pivot passage through each domino, and positioning the pivot passage closer to the first end than to the second end of each domino; and (c) limiting rearward rotation of each domino by means of the rear wall of the playing box.

13. The method of playing a domino and dice game according to the method of claim 9, further including the steps of:

(a) installing a second row backstop between the first domino pivot and the second domino pivot of the playing box; and (b) limiting rearward rotation of the dominos of the second domino pivot and limiting forward rotation of the dominos of the first domino pivot, by means of the second row backstop.

14. The method of playing a domino and dice game according to the method of claim 9, further including the steps of:

(a) pivoting all of the doubles dominos to an upwardly facing position, with the counts being visible;

(b) randomly tossing the dice and achieving identical counts upon each of the dice; and (c) turning doubles dominos face down which have counts matching the numerical count of the dice toss.

15. The method of playing a domino and dice game according to the method of claim 9, further including the steps of:

(a) installing a third laterally disposed domino pivot extending across the domino area and between the lateral walls of the playing box; and (b) pivotally installing six blank dominos along the third domino pivot, with the blank dominos having blank portions and count portions totaling from one to six, inclusive, and being independently pivoted along the third domino pivot.

16. The method of playing a domino and dice game according to the method of claim 15, further including the steps of:

(a) installing a third row backstop between the second domino pivot and the third domino pivot of the playing box; and (b) limiting rearward rotation of the dominos of the third domino pivot and limiting forward rotation of the dominos of the second domino pivot, by means of the third row backstop.

17. The method of playing a domino and dice game according to the method of claim 15, further including the steps of:

(a) pivoting all of the blank dominos to an upwardly facing position, with the count portions being visible; and (c) turning blank dominos face down which have counts matching the numerical count of the dice toss, when combined with the remaining count of at least one of the dominos of the first domino pivot.

18. The method of playing a domino and dice game according to the method of claim 9, further including the steps of:

(a) providing a wagering surface;

(b) providing a plurality of identical wagering areas upon the wagering surface;

(c) providing a plurality of domino numerical combinations and payout odds disposed upon each of the wagering areas;

(d) placing at least one wager upon at least one of the wagering areas; and (e) collecting the at least one wager or paying out winnings upon the at least one wager, according to the outcome of the play upon which the wager was placed.

* * * * *